US007721576B2

(12) United States Patent
Amir

(10) Patent No.: US 7,721,576 B2
(45) Date of Patent: May 25, 2010

(54) LOCK CYLINDER OPENING SYSTEM AND METHOD

(75) Inventor: Haim Amir, Ramat Hasharon (IL)

(73) Assignee: Essence Security International Ltd, Herziliya, IL (US)

( * ) Notice: Subject to any disclaimer, the term of this patent is extended or adjusted under 35 U.S.C. 154(b) by 346 days.

(21) Appl. No.: 11/842,195

(22) Filed: Aug. 21, 2007

(65) Prior Publication Data

US 2009/0049878 A1 Feb. 26, 2009

(51) Int. Cl.
*E05B 47/00* (2006.01)

(52) U.S. Cl. ..... 70/472; 70/218; 70/278.7; 70/279.1; 292/142; 292/144; 292/DIG. 27

(58) Field of Classification Search ..... 70/277, 70/279.1, 223, 422, 188, 189, 472, 218, 149, 70/278.7, 280–283; 292/142, 144, DIG. 27
See application file for complete search history.

(56) References Cited

U.S. PATENT DOCUMENTS

| | | | | | |
|---|---|---|---|---|---|
| 1,576,574 | A * | 3/1926 | Claussen | 70/149 |
| 3,785,188 | A * | 1/1974 | Drathschmidt | 70/276 |
| 3,889,501 | A | 6/1975 | Fort | |
| 4,393,672 | A * | 7/1983 | Gelhard | 70/277 |
| 4,438,962 | A * | 3/1984 | Soloviff et al. | 292/144 |
| 4,956,984 | A * | 9/1990 | Chi-Cheng | 70/277 |
| 5,000,018 | A * | 3/1991 | Eisermann | 70/277 |
| 5,095,654 | A * | 3/1992 | Eccleston | 49/280 |
| 6,147,622 | A | 11/2000 | Fonea | |
| 6,244,084 | B1 * | 6/2001 | Warmack | 70/278.1 |
| 6,283,515 | B1 * | 9/2001 | Redan | 292/144 |
| 6,714,118 | B1 | 3/2004 | Frolov et al. | |
| 6,758,070 | B2 * | 7/2004 | Yu et al. | 70/107 |
| 6,845,642 | B2 * | 1/2005 | Imedio Ocana | 70/277 |
| 6,886,381 | B2 * | 5/2005 | Geurden | 70/360 |
| 7,069,755 | B2 | 7/2006 | Lies et al. | |
| 7,096,698 | B2 * | 8/2006 | Walsh et al. | 70/472 |
| 7,516,633 | B1 * | 4/2009 | Chang | 70/472 |
| 2001/0005998 | A1 * | 7/2001 | Imedio Ocana | 70/277 |
| 2001/0010166 | A1 * | 8/2001 | Doucet et al. | 70/279.1 |
| 2003/0071470 | A1 * | 4/2003 | Yeh | 292/144 |
| 2003/0160681 | A1 | 8/2003 | Manerd et al. | |
| 2004/0177660 | A1 * | 9/2004 | Tsai | 70/223 |
| 2004/0250578 | A1 * | 12/2004 | Sakai | 70/277 |
| 2005/0172685 | A1 * | 8/2005 | Keightly | 70/279.1 |
| 2006/0117819 | A1 * | 6/2006 | Kilbourne | 70/257 |

* cited by examiner

*Primary Examiner*—Lloyd A Gall
(74) *Attorney, Agent, or Firm*—Mark M. Friedman

(57) ABSTRACT

A lock cylinder opening system comprising: a lock cylinder body housing with a direction of elongation defining an axial direction for the system, having a first and a second end, and having a first and a second axial bores; a rotatable first cylindrical plug in the first bore, the first plug having an axially extending key slot from the first end of the lock cylinder; a rotatable second cylindrical plug in the first bore, the second plug extending to the second end; a rotatable opening shaft in the second bore, the opening shaft extending at the first and second ends of the lock cylinder; and a selector unit positioned at the second end, having a mechanical connection with the second plug and receiving the opening shaft, the selector unit adapted to selectively enable and disable rotation of the second plug by rotation of the opening shaft.

24 Claims, 9 Drawing Sheets

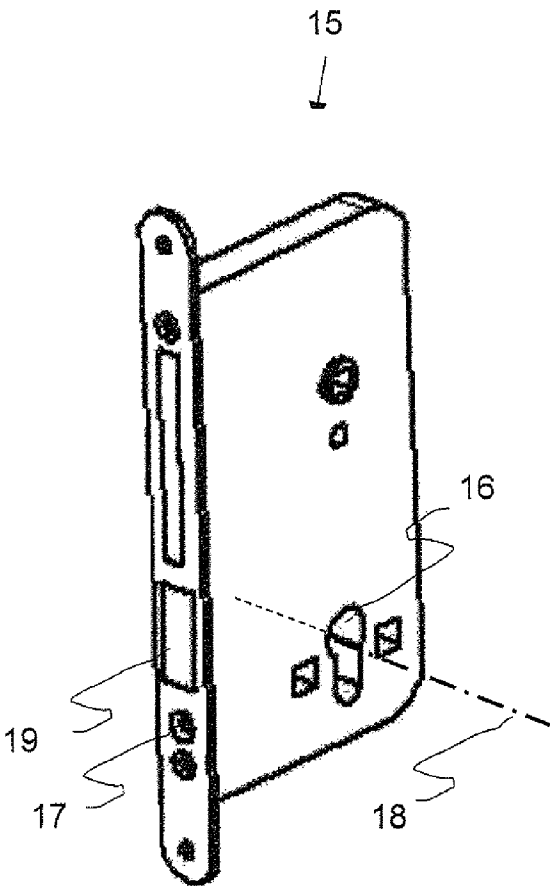
FIG. 1B – PRIOR ART
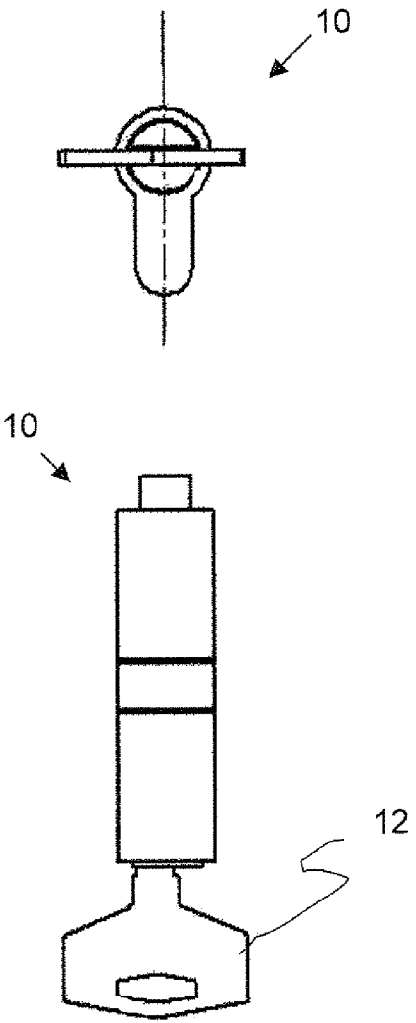
FIG. 1A – PRIOR ART

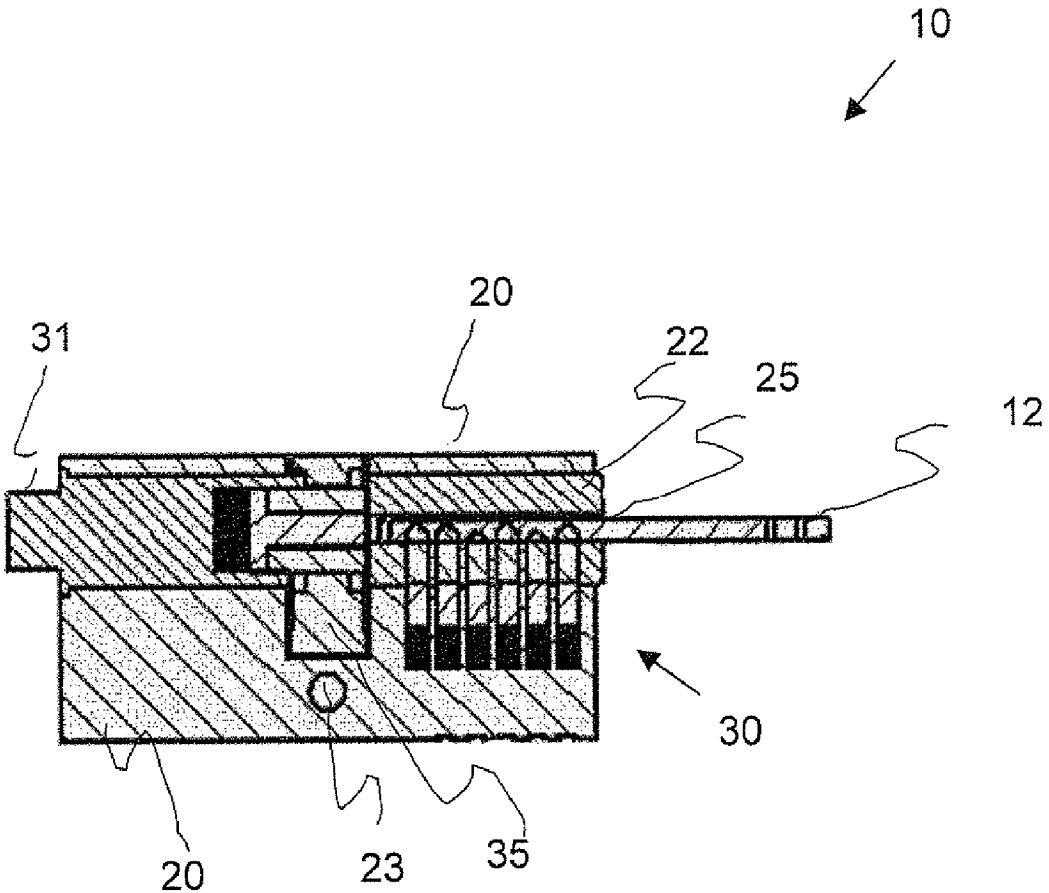
FIG. 2 – PRIOR ART

LOCK CYLINDER OPENING SYSTEM AND METHOD

FIELD AND BACKGROUND OF THE INVENTION

The present invention relates to a lock cylinder opening system and method and, in particular, it concerns a retrofittable system that can be operated to electrically open a cylinder lock, such as used in doors, with minimal power utilization and one which may also be operated conventionally with a key.

In a conventional mechanical cylinder lock, when an appropriate matching key is inserted into the cylinder lock, the key serves to mechanically align tumbler pins ("unlocked" or "opened" state), allowing the cylindrical plug to be rotated freely to retract a bolt which is typically mechanically connected the cylindrical plug and is driven by the rotated cylindrical plug. Retraction of the bolt is typically referred to as "unbolting" the lock. Conversely, when the cylindrical plug is rotated (usually in a direction opposite that used for unbolting) and the bolt is extended in such a way as to inhibit movement of a door or window, etc. the action is referred to as "bolting" the lock. Following bolting, the key is typically withdrawn from the key slot, the tumbler pins are not aligned, which inhibits free rotation of the cylindrical plug, and the lock is then in a "locked" or "closed" state.

In a conventional mechanical cylinder lock, when an appropriate matching key is inserted into the cylinder lock, the key serves to mechanically align tumbler pins, and thereby allowing the cylindrical plug to be rotated freely to open the lock. Referring now to FIGS. 1A and 1B, which are representations of a prior art cylinder lock 10, with a key 12 inserted into the cylinder lock, and a door lock 15. Door lock 15 includes, inter alia, a shaped slot 16 for receiving cylinder lock 10 and a door lock hole 17 through which a bolt (not shown) is inserted to secure the cylinder lock inside the door lock. Typically, door lock 15 is inserted into a hollowed-out edge of the door (not shown) and cylinder lock 10 is inserted through prepared holes in the door (not shown in the figure) and perpendicularly into and through shaped slot 16, substantially along axis 18. Door lock further includes a bolt 19. Typically, cylinder lock 10, when unlocked, serves to translate bolt 19 into the door lock, so that bolt 19 is substantially flush and the door lock is referred to as "unbolted". When bolt 19 translated out of door lock 15, the door lock is "bolted". Typically, other cylinder locks having a cross-sectional profile and length substantially matching cylinder lock 10 may be replaced or retrofitted instead of cylinder lock 10. Typical names/manufacturers of such cylinder locks include, but are not limited to: Euro Cylinders; Oval Cylinders; Asec 6-pin Euro profile; and Chubb M3. Overall lengths of such cylinders typically vary from approximately 60-110 mm.

Reference is now made to FIG. 2, which is a cross sectional side view of the cylinder lock shown in FIG. 1A. The cylinder lock has a body housing 20, which is bored from one end to the other end and a cylindrical plug 22, which is fitted into the bore, and which may be rotated, as described hereinbelow. A set hole 23 is located approximately in the middle of cylinder lock 10 to typically receive a threaded bolt (not shown in the figure) which is inserted into lock hole 17, to secure the cylinder lock within door lock 15, as described hereinabove in FIG. 1B. Cylindrical plug 22 has a key slot 25 formed axially in cylindrical plug. Key 12 is inserted into slot 25. A pin-tumbler set 30 is located in body housing 20 and in cylindrical plug 22 to serve to lock and unlock rotational movement of cylindrical plug 22. Cylindrical plug 22 and a second cylindrical plug 31 may be mechanically coupled and uncoupled to a rotating tongue 35 by means of a clutch unit (not shown in the figure), which allows either of the two cylindrical plugs to rotate the rotating tongue, which in turn serves to move the bolt of the door lock (refer to FIG. 1B). The cylinder lock shown in FIG. 2 is called a "blind cylinder", in that a key can be inserted into only one side of the lock. However, cylinder lock 10 may also comprise pin-tumbler sets and key slots in respective cylindrical plugs at both ends.

A number of prior art electronic or combination electrical/mechanical lock systems allow a user to open a locked cylinder in a number of ways. In U.S. Pat. No. 3,889,501 by Fort, whose disclosure is incorporated herein by reference, a combination electrical and mechanical system is described. The system includes a lock having a fixed lock cylinder and a rotatable key slug. A first solenoid is employed in the current system to drive a lock pin, which is normally extended to lock the key slug. Upon insertion of an appropriately aperture-encoded key, light sources and detectors mounted in the lock are used in concert with appropriate circuitry to operate to the first solenoid to unlock key slug. A second solenoid is operable, in response to an electrical power failure, to extend a bolt pin. When the bolt pin is extended a proper mechanical key is inserted and rotated, extension of the lock pin is prevented. A proper mechanical key can be inserted to move a plurality of spring loaded pin tumblers in the lock to enable rotation of the key slug during an electrical power failure.

Fonea, in U.S. Pat. No. 6,147,622, whose disclosure is incorporated herein by reference, discloses an electronic lock system which is also manually operable to drive a lock cylinder to move a lock mechanism which includes at least one bolt. The system includes a bidirectional motor engagable with the lock cylinder. At least one sensor in the lock system is used in conjunction with an angular measurement device and/or stepper motor feedback to provide a level of lock self diagnostics and self testing. The system may also be operated in a mechanical manner. Additional features of the lock system, not related to the capabilities noted hereinabove are also disclosed.

While the prior art includes an array of combination electrical/mechanical lock systems of varying complexity and systems that employ motorized opening of a cylindrical lock, the problem of relatively high power necessary to open the cylinder lock and to bolt and unbolt the door remains. Attempts to solve this problem necessitate employing systems with limited reliability, especially when onboard power is necessary to power motors. There is therefore a need for a combination electrical/mechanical lock cylinder opening system that has the capability to be operated with high reliability over time, utilizing little power, and which can easily be retrofitted to an existing lock installation. The system should be remotely operated to allow unbolting and bolting of the lock and to allow the same operations to be performed in a conventional manual manner in case of an electrical power failure. Furthermore, such a system should be integrated with capabilities of electrically and manually locking and unlocking the lock.

SUMMARY OF THE INVENTION

The present invention is a lock cylinder opening system and method and, in particular, it concerns a retrofittable system that can be operated to electrically open a cylinder lock, such as used in doors, with minimal power utilization and one which may also be operated conventionally.

According to the teachings of the present invention there is provided, a lock cylinder opening system comprising: a lock cylinder body housing with a direction of elongation defining an axial direction for the system, having a first and a second end, and having a first and a second axial bores; a rotatable first cylindrical plug in the first bore, the first plug having an axially extending key slot from the first end of the lock cylinder; a rotatable second cylindrical plug in the first bore, the second plug extending to the second end; a rotatable opening shaft in the second bore, the opening shaft extending at the first and second ends of the lock cylinder; and a selector unit positioned at the second end, having a mechanical connection with the second plug and receiving the opening shaft, the selector unit adapted to selectively enable and disable rotation of the second plug by rotation of the opening shaft. Preferably, the selector unit is adapted to allow manual rotation of the second plug from the second end of the lock cylinder. Most preferably, the selector unit includes a control and communications unit; a clutch unit; and a power subassembly.

Typically, the control and communications unit is adapted to receive command signals, to transmit telemetry signals, and to control the clutch unit. Most typically, the clutch unit includes a motor. Preferably, the motor is adapted to operate the clutch unit and to mechanically engage and disengage the rotatable shaft and the second plug. Most preferably, the control and communications unit is further adapted to sense the status of the motor and of the clutch unit and to include information indicative of system status in the telemetry signals. Typically the power assembly is adapted to provide power to the system, the power assembly including at least one chosen from a list including: batteries, mains power, and battery and mains power.

Preferably, a matching key is insertable in the key slot to open and rotate the first plug. Most preferably, the lock cylinder body housing is retrofittable in place of a conventional lock cylinder. Typically, the selector unit is retrofittable along with the body housing. Most typically, the selector unit is retrofittable modularly to the body housing.

According to the teachings of the present invention there is provided a method of opening a lock system comprising the steps of: taking a lock cylinder body housing with a direction of elongation defining an axial direction for the system, having a first and a second end, and having a first and a second axial bores; configuring a rotatable first cylindrical plug in the first bore, the first plug having an axially extending key slot from the first end of the lock cylinder; placing a rotatable second cylindrical plug in the first bore, the second plug extending to the second end; configuring a rotatable opening shaft in the second bore, the opening shaft extending at the first and second ends of the lock cylinder; and positioning a selector unit at the second end, having a mechanical connection with the second plug and receiving the opening shaft, the selector unit selectively enabling and disabling rotation of the second plug by rotation of the opening shaft. Preferably, the selector unit allows manual rotation of the second plug from the second end of the lock cylinder. Most preferably, the selector unit includes a control and communications unit; a clutch unit; and a power subassembly. Typically, the control and communications unit receives command signals, transmits telemetry signals and controls the clutch unit.

Most typically, the clutch unit includes a motor. Preferably, the motor operates the clutch unit and mechanically engages and disengages the rotatable shaft and the second plug. Most preferably, the control and communications unit is further senses the status of the motor and of the clutch unit and includes information indicative of system status in the telemetry signals. Typically, the power assembly provides power to the system, the power assembly including at least one chosen from a list including: batteries, mains power, and battery and mains power.

Preferably, a matching key is inserted in the key slot to open and rotate the first plug. Most preferably, the lock cylinder body housing is retrofitted in place of a conventional lock cylinder. Typically, the selector unit is retrofitted along with the body housing. Most typically, the selector unit is retrofitted modularly to the body housing.

BRIEF DESCRIPTION OF THE DRAWINGS

The invention is herein described, by way of example only, with reference to the accompanying drawings, wherein:

FIGS. 1A and 1B are representations of a prior art cylinder lock and a door lock, respectively;

FIG. 2 is a cross sectional side view of the prior art cylinder lock shown in FIG. 1A;

DESCRIPTION OF PREFERRED EMBODIMENTS

The present invention includes a lock cylinder opening system and method.

Figure 3:
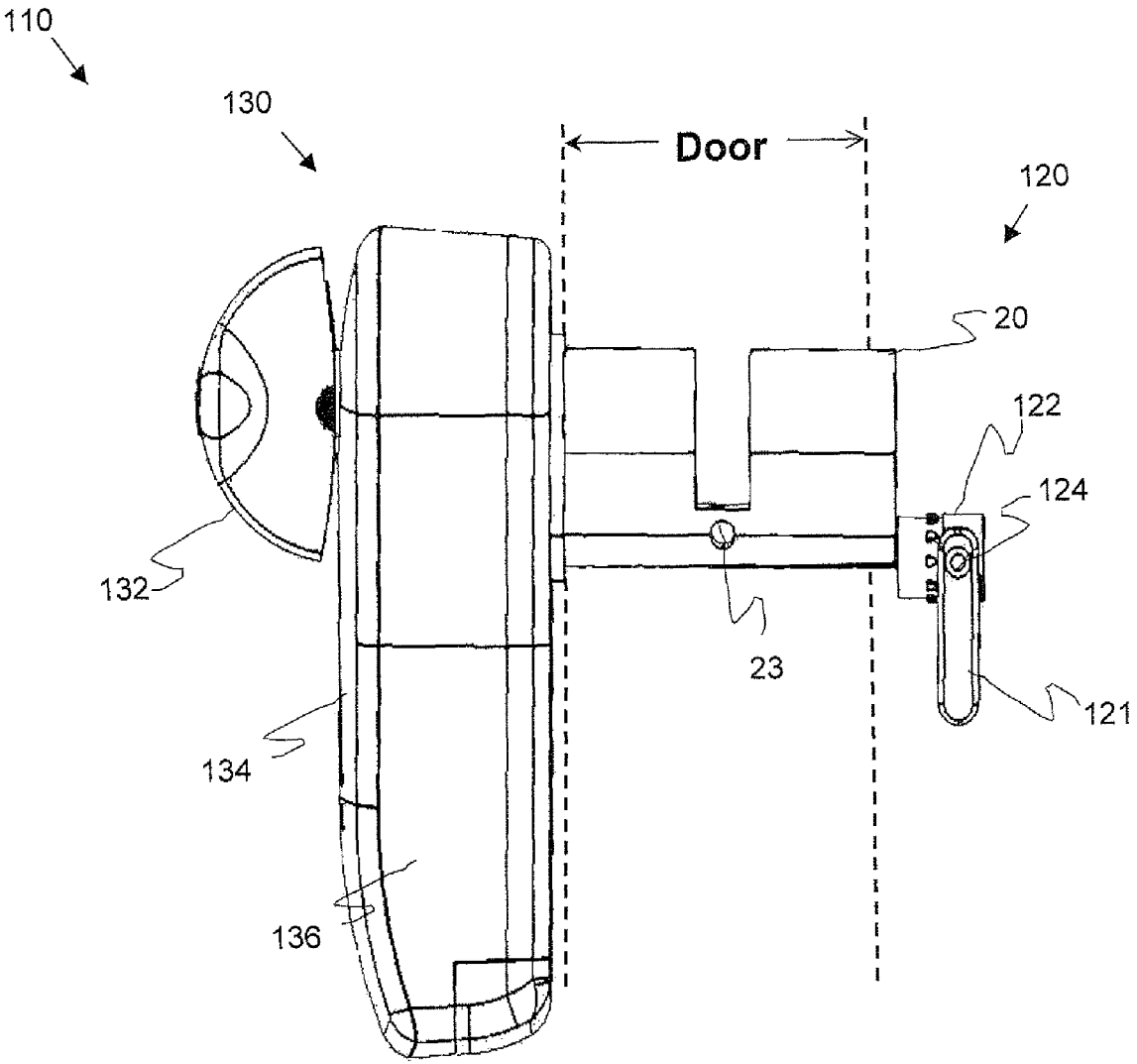
FIG. 3 is a side view of a lock cylinder opening system, in accordance with an embodiment of the present invention.
Figure 4B:
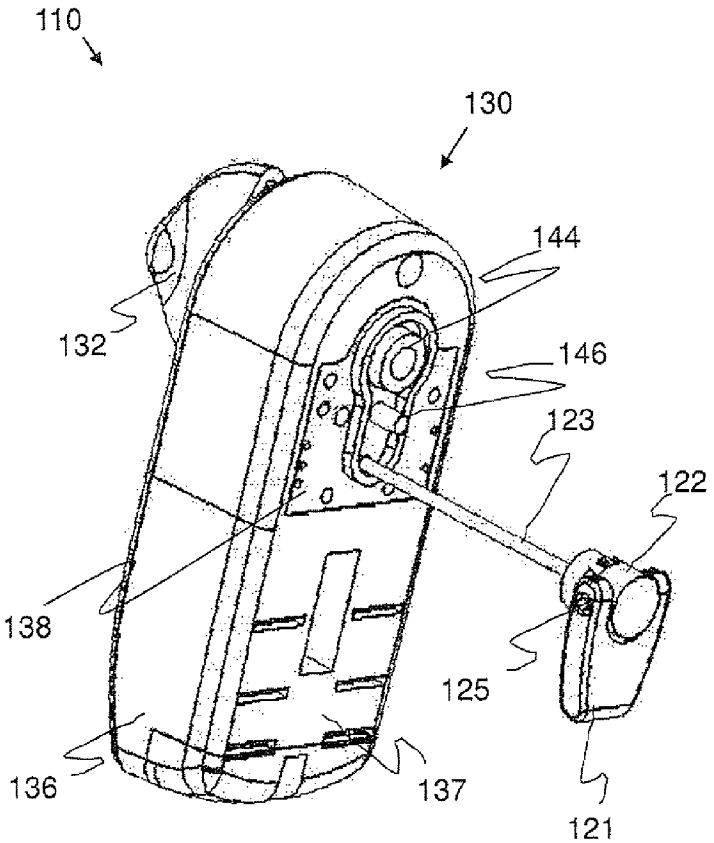
FIGS. 4A and 4B are isometric views of the lock cylinder opening system of FIG. 3, respectively with and without an integral cylinder lock module.
Figure 4A:
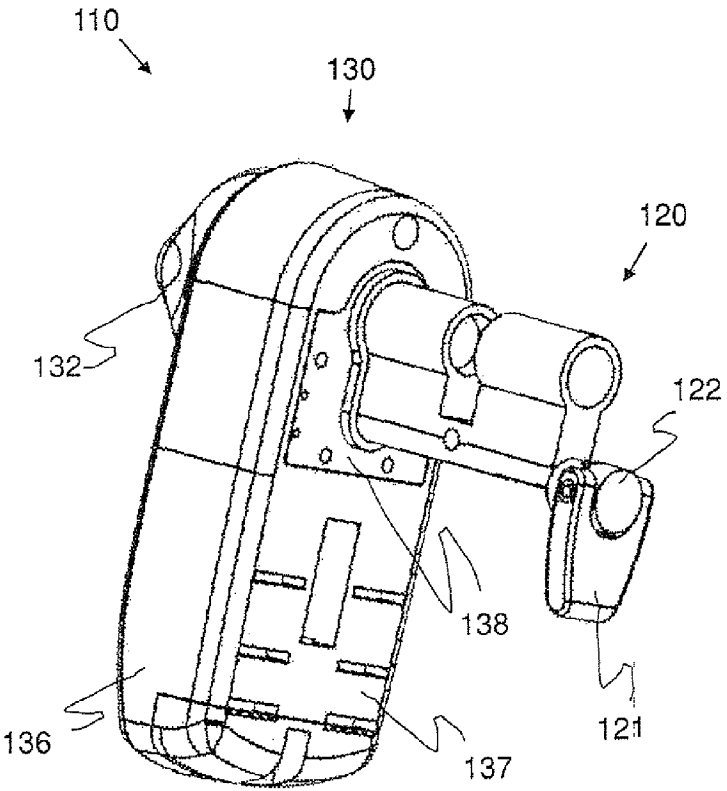

Reference is now made to FIGS. 3, 4A, and 4B which are, respectively, a side view of a lock cylinder opening system 110 and pictorial representations of the cylinder opening system 110 shown with and without an integral cylinder lock module 120, in accordance with an embodiment of the present invention. System 110 includes integral cylinder lock module 120, which is connected to a selector unit 130—the functioning of both modules described hereinbelow. Apart from differences described below, cylinder lock module 120 is generally similar to operation of cylinder lock 10 as shown in FIGS. 1A, 1B, and 2, so that elements indicated by the same reference numerals are generally identical in configuration and operation. The general orientation of system 110 relative to a typical door is indicated by the dotted lines and the "Door" indication in the figure, indicating a cross section or "thickness" of the door. Cylinder lock module 120 is show in the present figures without cylinder plug 22 (refer to FIG. 2). Cylinder lock module 120 is mechanically connected to selector unit 130 and at the "blind end" of the cylinder lock module.

At the "key end" of cylinder lock module 120, a hinged handle 121, having a general shape allowing it to be grasped similarly to a key, is connected to a generally cylindrical fitting 122, which is mechanically connected to opening shaft 123. (Opening shaft 123 is shown in FIG. 4B.) Opening shaft 123 has a generally elongated cylindrical shape and passes through a bore (not shown in the figures) in the lower part of cylinder lock module 120. Opening shaft 123 is typically fabricated from a rigid metal, allowing the shaft to transfer torque sufficient to activate selector unit 130, as described hereinbelow. Hinged handle 121 is connected to cylindrical fitting 122 by means of axis 125, which may be a set pin or other suitable hinge device, allowing hinged handle 121 to be oriented generally parallel to opening shaft 123 (so that the hinged handle may be grasped to rotated the opening shaft) and allowing hinged handle 121 to be stowed generally parallel to the end of cylinder lock module 120 when the hinged handle is not in use. Hinged handle 121 and cylindrical fitting 122 may be removed from and later reattached to opening shaft 123 to allow cylinder 120 to be inserted into the door, when, for example, system 110 is retrofitted in the door, by sliding cylinder 120 from the secured side into shaped slot 17 (see FIG. 1B). Alternatively or optionally, hinged handle 121 and cylindrical fitting 125 may be shaped sufficiently compactly to allow them to remain fixed to opening shaft 123 when retrofitting system 110 in the door.

Typically, although not obligatorily, selector unit 130 is configured "inside" or on the side of the door which is considered secured; and hinged handle 121 is configured "outside", or on the side of the door which is considered unsecured. The unsecured side of the door is typically the side of the door from where a key may be used to open cylinder lock module 120. Selector unit 130 is oriented substantially parallel and close to the door. A cylinder rotation knob 132 serves to freely rotate a blind cylinder (not shown) in cylinder lock module 120. An outer cover 134, a lateral cover 136, and a door-side cover 137 serve to cover and protect the selector unit, as well as supporting some components of the selector unit, as described hereinbelow. Covers 134, 136, and 137 are typically made of a sturdy and lightweight plastic material, but may also be fabricated from a metallic material. Support 138, fabricated from a rigid metallic material, serves to support and hold components of the selector unit as described hereinbelow and to mate with cylinder lock module 120 as shown in the figures, including a blind cylinder shaft 144, which at one end is connected to cylinder rotation knob 132 and which is connected at a second end with the blind cylinder (not shown in the figures) of cylinder lock module 120, thereby allowing the blind cylinder to be rotated by rotating the cylinder rotation knob. A stabilizing pin 146, located beneath the blind cylinder shaft, protrudes from selector unit 130 as shown to mate with a matching hole (not shown) in the blind cylinder and thereby support and stabilize the blind cylinder while also ensuring minimal or no lateral forces are applied to opening shaft 123. Opening shaft 123 is connected to components within Selector unit 130 as described hereinbelow.

Figure 5:
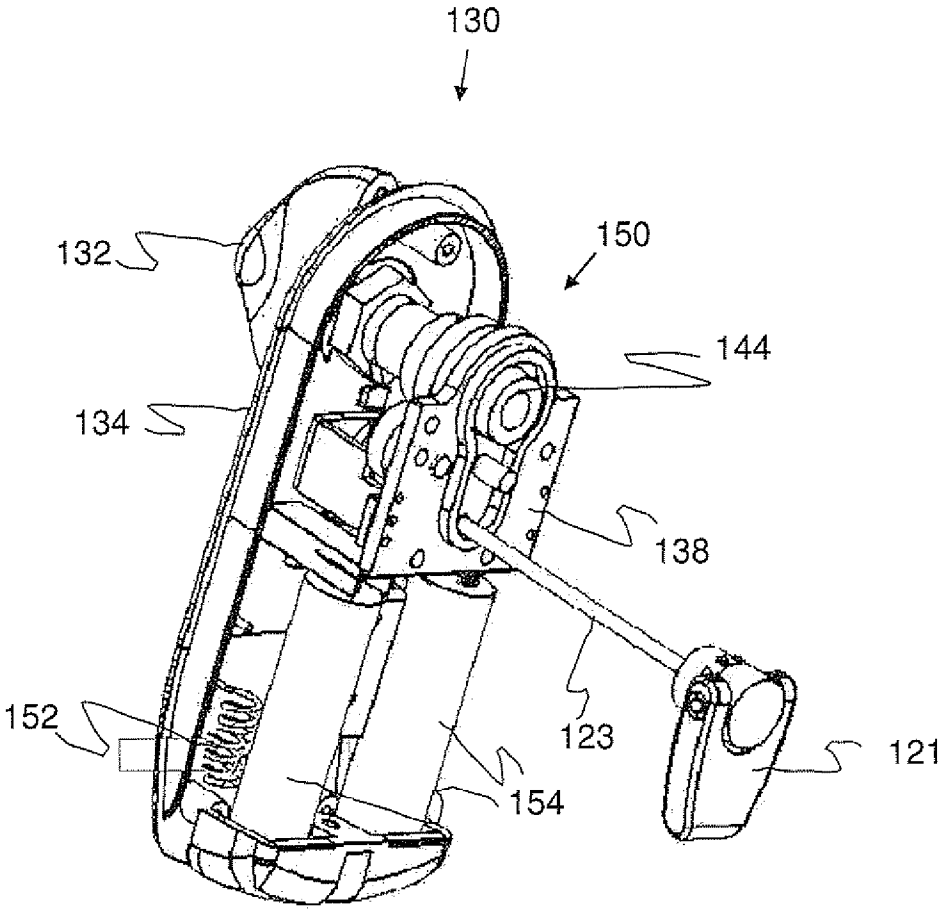
FIG. 5 is an isometric view of the lock cylinder opening system of FIGS. 3, 4A, and 4B with covers removed.
Figure 6:
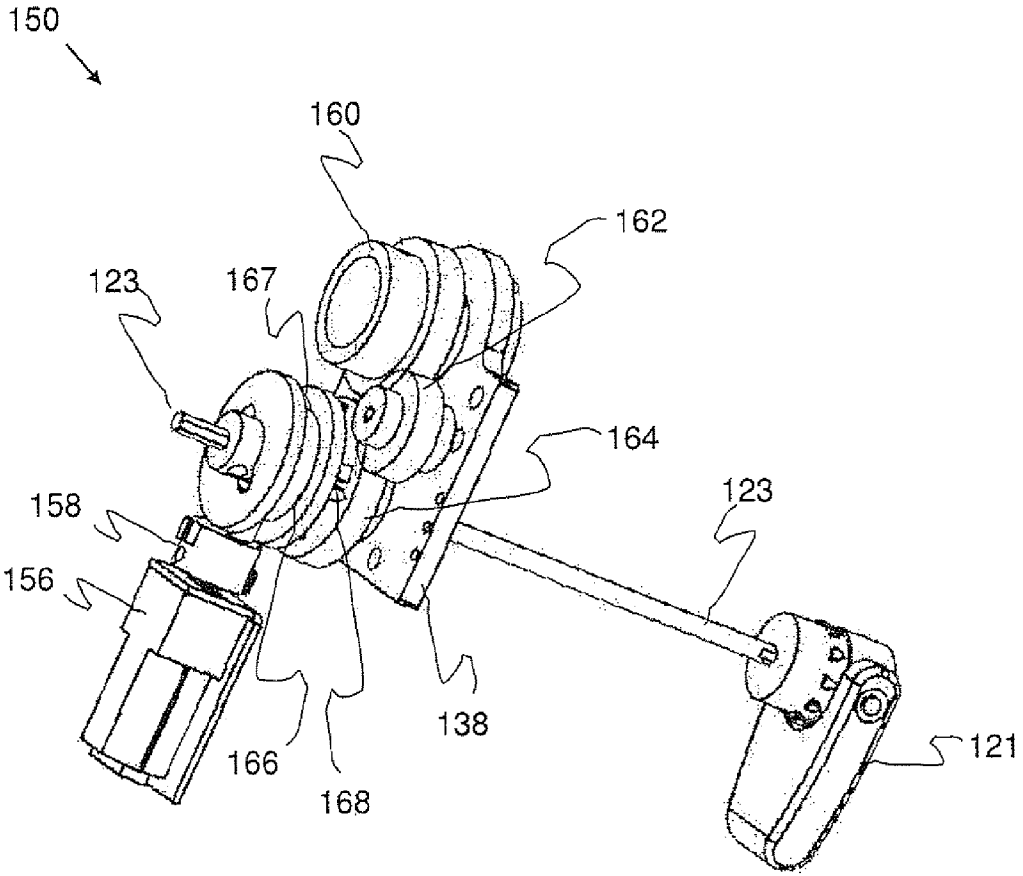
FIG. 6 is an isometric detailed view of a selector unit in accordance with an embodiment of the present invention.

Reference is now made to FIG. 5, which is an isometric view of the lock cylinder opening system of FIG. 4B with covers 136, and 137 removed, and to FIG. 6, which is an isometric view of a clutch unit 150, in accordance with an embodiment of the current invention. Apart from differences described below, elements indicated by the same reference numerals in the present figures are generally identical in configuration and operation as noted in previous figures. Selector unit 130 further includes a clutch unit 150, a control and communications unit 152, and a power assembly 154. In one embodiment of the present invention, power assembly 154 includes typical rechargeable or one-time batteries. Alternatively or optionally, power assembly 154 may use mains power or a combination of mains power and batteries, such as with rechargeable batteries that maintain a charge when normally supplied mains power is discontinued. Power assembly 154 supplies power to operate selector unit 130 and specifically the clutch unit, as described hereinbelow, and to power control and communications unit 152, which is responsible for command and telemetry communications for selector unit 130 and for sensing, controlling, and reporting the status of components of the selector unit, including the status of clutch unit 150. Command and telemetry communications are effected primarily by wireless means but they may alternatively or optionally be effected by wired means.

The clutch unit includes motor 156, eccentric driver 158, gears 160, 162, and 164 (represented as truncated cylindrical shapes in the figure), and clutch wheel 166, further described hereinbelow. Gears 160, 162, and 164 are supported from support 138. Gear 160 is mechanically connected to blind cylinder shaft 144 (shown previously in FIG. 4B) which passes axially through gear 160 and which rotates with gear 160. Gears 160, 162, and 164 are configured and engaged so that rotation of gear 164 provides rotation of gear 160 and of blind cylinder shaft 144. Motor 156 is configured and fixed substantially perpendicular to opening shaft 123. The opening shaft enters clutch unit 150 from the side of support 138 and exits clutch unit 150 from the side of clutch wheel 166. Gear 164 and clutch wheel 166 are configured coaxially with opening shaft 123. Opening shaft 123 is mechanically attached to clutch wheel 166 so that rotation of opening shaft rotates the clutch wheel; however clutch wheel 166 is free to move axially along opening shaft 123, towards and away from gear 164, through which opening shaft passes. Examples of suitable attachment means of opening shaft 123 to clutch wheel 166 may be a matching regular geometric cross-section (square, hexagonal, etc) or other matching cross-sectional shapes (keyed or slotted, for example) of the end of shaft 123 fitted within the central opening of clutch wheel 166.

Operation of clutch unit 150 is described hereinbelow. Clutch wheel 166 is typically not engaged, meaning that upon rotation of opening shaft 123, because there is no mechanical connection between the clutch wheel and gear 164, only clutch wheel 166 rotates. Clutch wheel 166 is formed in a shape similar to a typical automobile wheel, meaning a generally truncated cylindrical shape having a lateral surface having a continuous peripheral depression 167, thereby leaving two lateral ridges. Eccentric driver 158 is mechanically and substantially coaxially fixed onto the shaft of motor 156 and motor 156 is mechanically fixed within selector unit 130. The eccentric driver has a pin (not shown in the figure) configured eccentrically from the eccentric driver axis of rotation and protruding from the edge of the driver facing the clutch wheel. The pin mates with peripheral depression 167 so that when motor 156 is commanded to operate, and eccentric driver 158 rotates, clutch wheel 166 is urged towards and away from gear 164.

One example of the movement of clutch wheel 166 towards and away from gear 164 could be that when the motor is commanded to rotate 180 degrees, the clutch wheel is moved a maximal distance towards gear 164 and that when the motor is further commanded to rotate 180 degrees more (i.e. to a 0 or 360 degree position), the clutch wheel is moved a maximal distance away from gear 164.

A plurality of engaging pins 168, typically 3 or more, are located on the surface of clutch wheel 166 facing gear 164 and are configured to mate with matching depressions (not shown in the figure) on the surface of gear 164 facing clutch wheel 166. When the clutch wheel is urged towards gear 164 and as the clutch wheel is rotated, engaging pins 168 engage the matching depressions, thereby mechanically connecting the clutch wheel and gear 164. When clutch wheel 166 is engaged, rotation of opening shaft 123 rotates gear 164, which serves to rotate gears 162 and 160, thereby rotates blind cylinder shaft 144 and the blind cylinder of the cylinder lock. Sensors located within components of clutch unit 150 provide feedback information to the communications unit.

In one embodiment of the current invention, opening shaft 123 has a diameter of 3.5 mm and is fabricated from 4340 Steel. In general, the diameter and material of opening shaft 123 are chosen to allow sufficient shaft strength while minimizing the diameter to pass through the bore (described hereinabove) in the lower part of cylinder lock module 120.

Typical operation of system 110 to open cylinder 120 from the unsecured side of the door, when no key is used includes:

Commanding selector unit 130 to activate clutch unit 150 to engage clutch wheel 166;

Turning hinged handle 121 to turn opening shaft 123 and thereby turn blind cylinder shaft 144, thereby opening the blind cylinder.

Note that commanding selector unit 130 to activate clutch unit 150 may be accomplished by wireless or wired means and commanding may be done in close proximity to system 110 or remotely, by the individual turning hinged handle 121, or by another person or device working with him, respectively. Examples of close proximity commanding include, but are not limited to: using a wireless RF device (key fob, for example) from the unsecured side; using a similar RF device to command from the secured side; and issuing a wired command. Examples of remote commanding include, but are not limited to wired or wireless commands from a control center or another remote location.

Figure 7B:
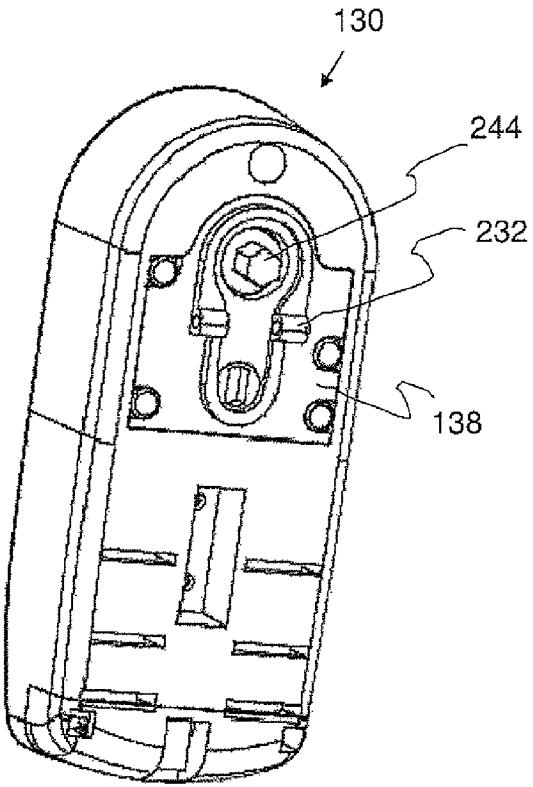
FIGS. 7A and 7B are isometric views of a lock cylinder opening system, in accordance with an embodiment of the present invention.
Figure 7A:
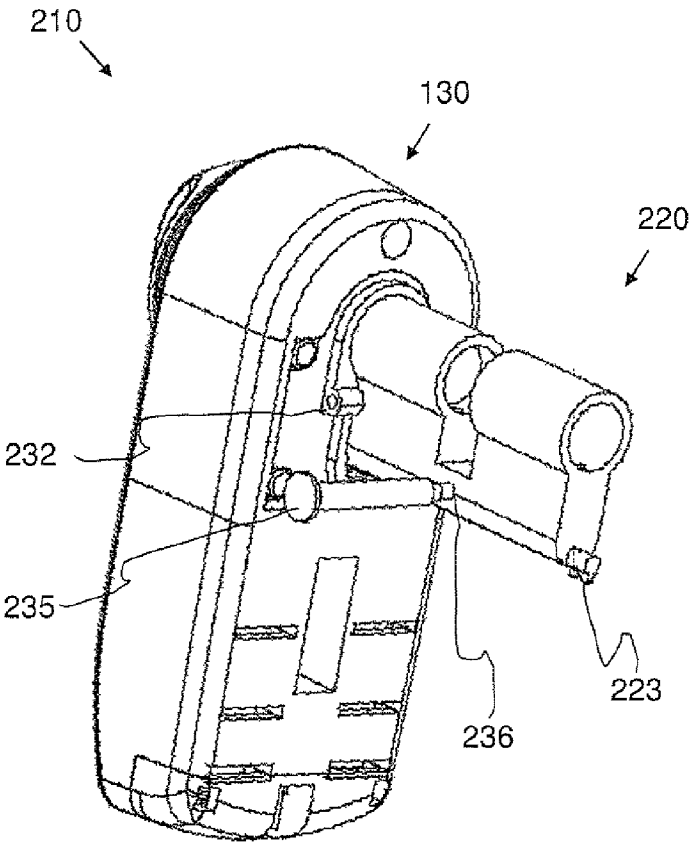

Reference is now made to FIG. 7A, which is an isometric view of a modular lock cylinder opening system 210, and to FIG. 7B, which is an isometric view of the modular lock opening system with modular cylinder unit 220 removed, in accordance with an embodiment of the present invention. Apart from differences described below, system 210 is generally identical in configuration and operation to system 110 as shown in FIGS. 3 and 4A and elements indicated by the same reference numerals in the present figures are generally identical in configuration and operation as noted in previous figures.

System 210 has features that allow for modular and more flexible retrofittablity in comparison to system 110. Opening shaft 223 is formed to allow it to be slid into modular cylinder unit 220 before or after the cylinder is retrofitted into slot 17 of the door. The shape of the unsecured-side end of the opening shaft allows for a variety of handles to be attached. The shape of the secured-side of the opening shaft allows for it to be easily inserted into selector unit 230 before or after modular cylinder unit 220 is retrofitted into slot 17 of the door. Additionally, as seen in FIGS. 7A and 7B, modular cylinder unit 220 may be readily attached to selector unit 230 by means of set screws (not shown) inserted into eyelets 232 formed into support 138 located on either side of where the modular cylinder abuts selector unit 230. Other elements that aid in easier retrofittablity and modularity of system 210 include blind cylinder shaft 244, which extends from selector unit 230 to dock with a matching socket in the blind cylinder (not shown) of modular cylinder unit 220. Blind cylinder shaft 244 may have a variety of cross sectional shapes, including, among others, hexagonal, square, and octagonal.

Because opening shaft is configured to pass through the lower part of the cylinder, as noted hereinabove, set hole 23 of units 120 and 220 must have a reduced diameter, when compared to the diameter of set hole 23 of the prior art (FIG. 1B). Retention bolt 235, which is inserted into lock hole 17 (FIG. 1B) and into set hole 23 (FIGS. 2 and 3) to retain the cylinder, has a tapered end 236 to allow it to be inserted into the reduced diameter of set hole 23 of units 120 and 220.

Figure 8B:
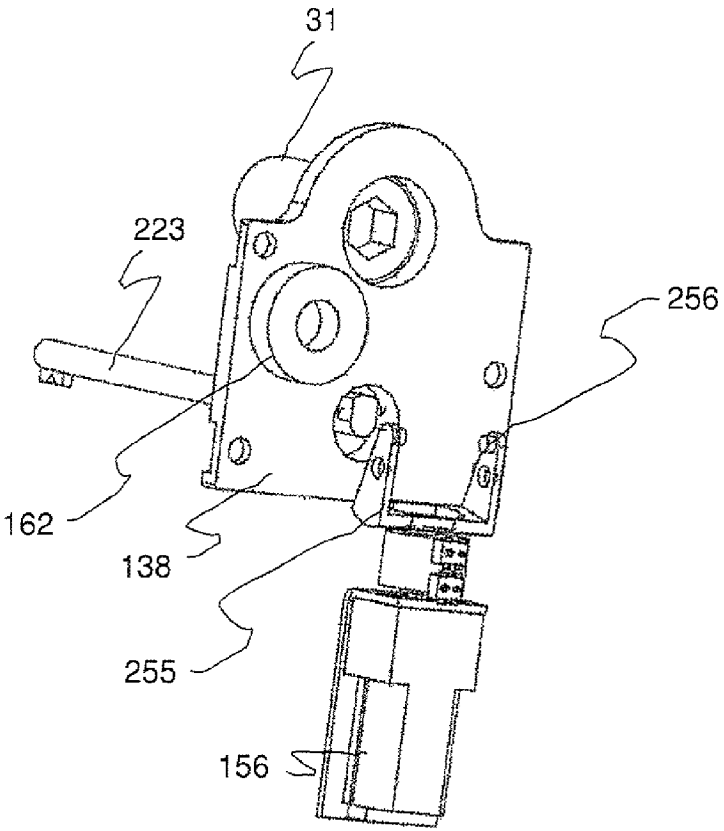
FIGS. 8A to 8D are isometric detailed views of a selector unit, in accordance with an embodiment of the present invention.
Figure 8A:
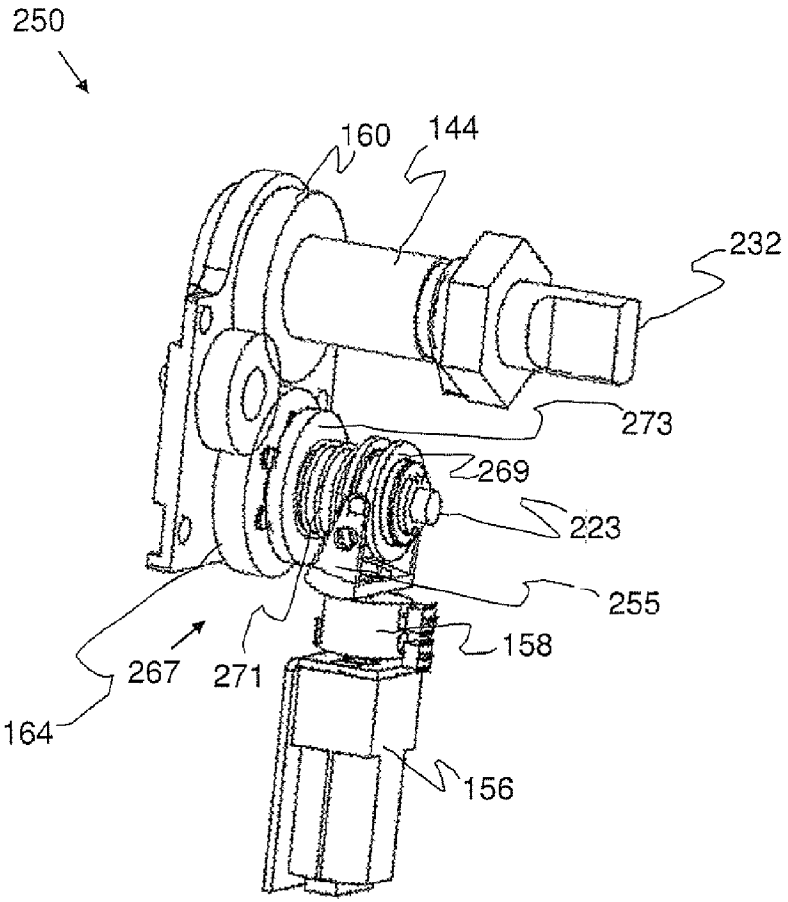
Figure 8D:
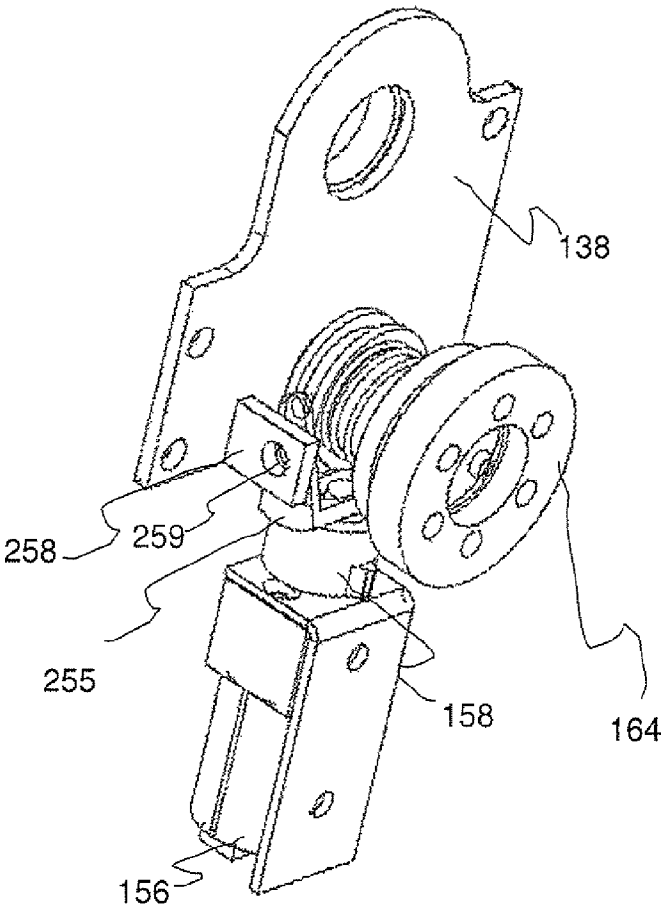
Figure 8C:
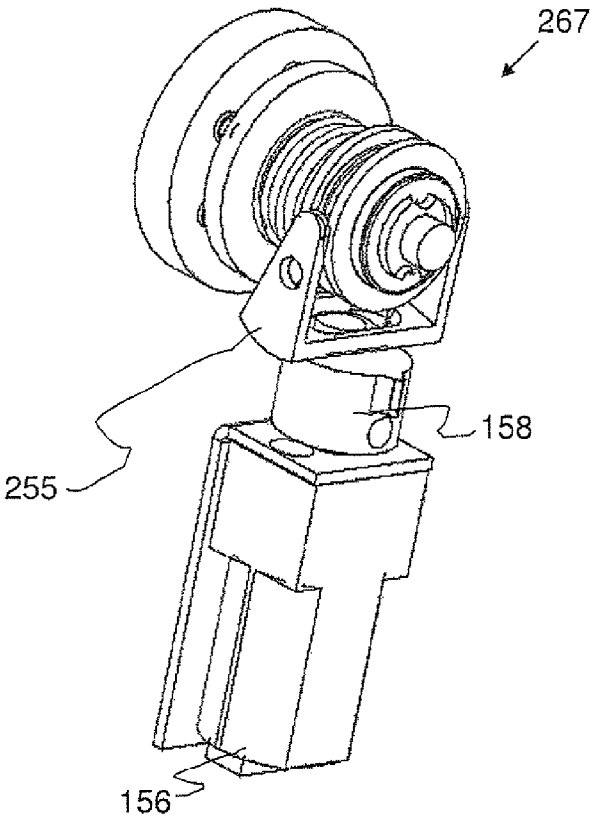

Reference is now made to FIG. 8A, which is an isometric detailed view of a selector unit 250, and to and FIGS. 8B and C, which are isometric details of the selector unit with some parts removed and others added, and to FIG. 8D, which is an isometric detail of the selector unit viewed from the reverse side of the views of FIGS. 8A-C, all in accordance with an embodiment of the present invention. Apart from differences described below, selector unit 250 is generally similar to operation of selector unit 150 as shown in FIG. 6, so that elements indicated by the same reference numerals in the present figures are generally identical in configuration and operation as noted in previous figures. Selector unit includes a clutch arm 255, secured in position by bracket 258 (refer to FIG. 8D) and a clutch unit 267. Bracket 258 serves to rotationally fix clutch arm 255 about axis 259 (indicated as a hole in bracket 258 and corresponding to a similar hole in clutch arm 255) so that the clutch arm rotates when it is driven and in turn drives other elements of selector unit 250 as described hereinbelow. Bracket 258 may be positioned with respect to clutch arm 255 to increase or decrease rotational movement of the clutch arm, depending on the relative position of axis 259, as may be apparent to one skilled in the art.

Clutch unit 267 further comprises a clutch wheel 269, a preload spring 271, and a clutch plate 273. Clutch arm 255 has a general "U" shape, with two arms and a base, and its base is connected to and driven by eccentric driver 158. Protrusions 256 on the inner surface near the end of each arm fit into the peripheral depression of clutch wheel 269, which has a general shape substantially identical to clutch wheel 166. Eccentric driver 158 drives the clutch arm which, in turn, urges the clutch wheel towards gear 164. In the present configuration, preload spring 271 is located between the clutch arm and clutch plate 273 and clutch plate 273 has a plurality of engaging pins (not shown in the present figure), which are located on the surface of clutch plate 273 facing gear 164 and are configured to mate with matching depressions (not shown in the figure) on the surface of gear 164 facing clutch plate 273. When selector unit 250 is commanded to engage the clutch plate with gear 164, preload spring 271 allows for efficient engagement of engaging pins with the matching depressions by providing a preload force, which acts to engage respective pins as they pass over matching depressions.

In one embodiment of the current invention selector unit 250 may be integrated into system 110, in place of selector unit 150.

It will be appreciated that the above descriptions are intended only to serve as examples, and that many other embodiments are possible within the scope of the present invention as defined in the appended claims.

What is claimed is:

1. A lock cylinder opening system comprising:

a lock cylinder with a direction of elongation defining an axial direction for the system, having a first and a second end, and having a first and a second axial bore;

a rotatable first cylindrical plug in the first bore, the first plug having an axially extending key slot from the first end of the lock cylinder;

a rotatable second cylindrical plug in the first bore, the second plug extending to the second end;

a rotatable opening shaft in the second bore, the opening shaft extending at the first and second ends of the lock cylinder; and a selector unit positioned at the second end, having a mechanical connection with the second plug and receiving the opening shaft, the selector unit adapted to selectively enable and disable rotation of the second plug by rotation of the opening shaft.

2. The lock cylinder opening system of claim 1, wherein the selector unit is adapted to allow manual rotation of the second plug from the second end of the lock cylinder.

3. The lock cylinder opening system of claim 2, wherein the selector unit includes a control and communications unit; a clutch unit; and a power subassembly.

4. The lock cylinder opening system of claim 3, wherein the control and communications unit is adapted to receive command signals, to transmit telemetry signals, and to control the clutch unit.

5. The lock cylinder system of claim 4, wherein the clutch unit includes a motor.

6. The cylinder lock system of claim 5, wherein the motor is adapted to operate the clutch unit and to mechanically engage and disengage the rotatable shaft and the second plug.

7. The lock cylinder system of claim 6, wherein the control and communications unit is further adapted to sense the status of the motor and of the clutch unit and to include information indicative of system status in the telemetry signals.

8. The lock cylinder system of claim 3, wherein the power subassembly is adapted to provide power to the system, the power subassembly including at least one chosen from a list including: batteries, mains power, and battery and mains power.

9. The lock cylinder opening system of claim 1, wherein a matching key is insertable in the key slot to open and rotate the first plug.

10. The lock cylinder opening system of claim 1, wherein the lock cylinder body housing is retrofittable in place of a conventional lock cylinder.

11. The lock cylinder opening system of claim 10, wherein the selector unit is retrofittable along with the lock cylinder.

12. The lock cylinder opening system of claim 10, wherein the selector unit is retrofittable modularly to the lock cylinder.

13. A method of opening a lock system comprising the steps of:

taking a lock cylinder with a direction of elongation defining an axial direction for the system, having a first and a second end, and having a first and a second axial bore;

configuring a rotatable first cylindrical plug in the first bore, the first plug having an axially extending key slot from the first end of the lock cylinder;

placing a rotatable second cylindrical plug in the first bore, the second plug extending to the second end;

configuring a rotatable opening shaft in the second bore, the opening shaft extending at the first and second ends of the lock cylinder; and positioning a selector unit at the second end, having a mechanical connection with the second plug and receiving the opening shaft, the selector unit selectively enabling and disabling rotation of the second plug by rotation of the opening shaft.

14. The method of claim 13, whereby the selector unit allows manual rotation of the second plug from the second end of the lock cylinder.

15. The method of claim 14, wherein the selector unit includes a control and communications unit; a clutch unit; and a power subassembly.

16. The method of claim 15, whereby the control and communications unit receives command signals, transmits telemetry signals and controls the clutch unit.

17. The method of claim 16, wherein the clutch unit includes a motor.

18. The method of claim 17, whereby the motor operates the clutch unit and mechanically engages and disengages the rotatable shaft and the second plug.

19. The method of claim 18, whereby wherein the control and communications unit further senses the status of the motor and of the clutch unit and includes information indicative of system status in the telemetry signals.

20. The method of claim 15, whereby the power subassembly provides power to the system, the power subassembly including at least one chosen from a list including: batteries, mains power, and battery and mains power.

21. The method of claim 13, whereby a matching key is inserted in the key slot to open and rotate the first plug.

22. The method of claim 13, whereby the lock cylinder is retrofitted in place of a conventional lock cylinder.

23. The method of claim 22, whereby the selector unit is retrofitted along with the lock cylinder.

24. The method of claim 22, whereby the selector unit is retrofitted modularly to the lock cylinder.

* * * * *